US008246406B2

(12) United States Patent
Field

(10) Patent No.: US 8,246,406 B2
(45) Date of Patent: Aug. 21, 2012

(54) FIN RETENTION SYSTEM FOR A WATER CRAFT

(76) Inventor: John Field, Hong Kong (CN)

( * ) Notice: Subject to any disclaimer, the term of this patent is extended or adjusted under 35 U.S.C. 154(b) by 177 days.

(21) Appl. No.: 12/709,980

(22) Filed: Feb. 22, 2010

(65) Prior Publication Data

US 2010/0273373 A1 Oct. 28, 2010

Related U.S. Application Data

(63) Continuation-in-part of application No. PCT/AU2008/001232, filed on Aug. 22, 2008.

(30) Foreign Application Priority Data

Aug. 22, 2007 (AU) ..... 2007904512

(51) Int. Cl.
*B63B 1/00* (2006.01)
*B63B 35/00* (2006.01)

(52) U.S. Cl. ..... 441/79

(58) Field of Classification Search ..... 441/65, 441/74, 79; 114/39.12, 39.15, 271, 274, 114/278, 279, 280, 284
See application file for complete search history.

(56) References Cited

U.S. PATENT DOCUMENTS 4,314,384 A * 2/1982 Weinhaus ..... 441/68
5,464,359 A 11/1995 Whitty
5,672,081 A 9/1997 Whitty
5,830,025 A 11/1998 Fleming
5,934,962 A 8/1999 Daum et al.
6,139,383 A 10/2000 Jolly et al.
6,386,933 B1 5/2002 Rewald et al.
6,752,674 B2 6/2004 Jolly
6,793,548 B2 9/2004 Jolly et al.
6,991,503 B2 1/2006 Garcia
6,991,504 B1 1/2006 English et al.
7,001,236 B2 2/2006 Blake, Jr.
7,198,532 B2 4/2007 Field (Continued)

FOREIGN PATENT DOCUMENTS

AU 199334088 A1 9/1993

(Continued)

OTHER PUBLICATIONS

International Preliminary Report on Patentability mailed Nov. 27, 2009 (for International Patent Application No. PCT/AU2008/001232).

(Continued)

*Primary Examiner* — Daniel Venne
(74) *Attorney, Agent, or Firm* — Nixon & Vanderhye P.C.

(57) ABSTRACT

A fin box for a water craft including: a fin box body having an elongated slot open at a first surface of the fix box and extending to a closed base of the fin box; a peripheral flange extending outwardly from the slot and defining an area of the first surface around the slot; the peripheral flange having a second lower surface and a third upper surface both offset vertically from the first surface and extending laterally from the fin box body, the second lower surface and said third upper surface further comprising a left and right side, each said left and right side surfaces extending transversely from the body portion to peripheral extremities of said peripheral flange, wherein at least one surface of said peripheral flange forms a transverse angle of taper with an axial median vertical plane of the fin box body.

19 Claims, 12 Drawing Sheets

U.S. PATENT DOCUMENTS

| | | | | |
|---|---|---|---|---|
| 7,497,752 | B2 * | 3/2009 | Field | 441/79 |
| 2003/0092333 | A1 | 5/2003 | McCausland et al. | |
| 2003/0124924 | A1 | 7/2003 | McCausland et al. | |
| 2006/0019559 | A1 | 1/2006 | Mair et al. | |
| 2006/0178061 | A1 | 8/2006 | Caldwell | |
| 2007/0202760 | A1 | 8/2007 | Caldwell et al. | |

FOREIGN PATENT DOCUMENTS

| | | | |
|---|---|---|---|
| AU | 199521660 | A1 | 11/1995 |
| DE | 4038517 | A1 | 6/1991 |
| EP | 0 834451 | A2 | 4/1998 |
| WO | 00/32466 | A1 | 6/2000 |
| WO | 01/70565 | A1 | 9/2001 |
| WO | 2003/002405 | A1 | 1/2003 |
| WO | 03/018395 | A1 | 3/2003 |
| WO | 03/095301 | A1 | 11/2003 |
| WO | 2004/035377 | A1 | 4/2004 |
| WO | 2006/021029 | A1 | 3/2006 |
| WO | 2006/077470 | A2 | 7/2006 |
| WO | 2007/045059 | A1 | 4/2007 |

OTHER PUBLICATIONS

Notification of International Search Report and The Written Opinion mailed Aug. 11, 2006.

Written Opinion mailed Aug. 11, 2006.

International Search Report mailed Aug. 11, 2006.

* cited by examiner

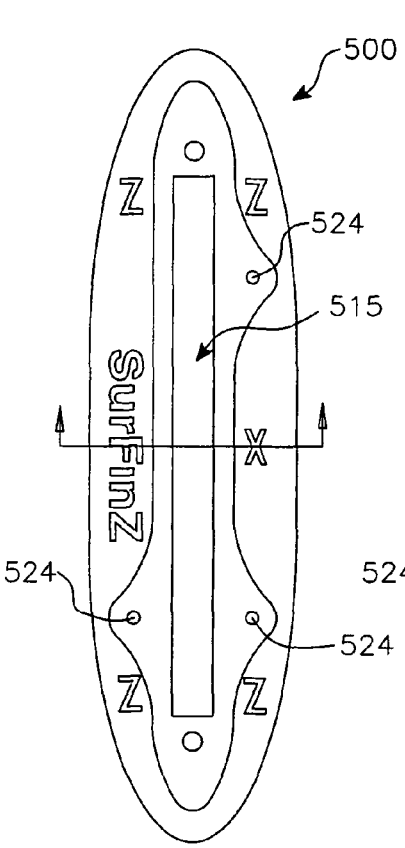
Fig. 12B1
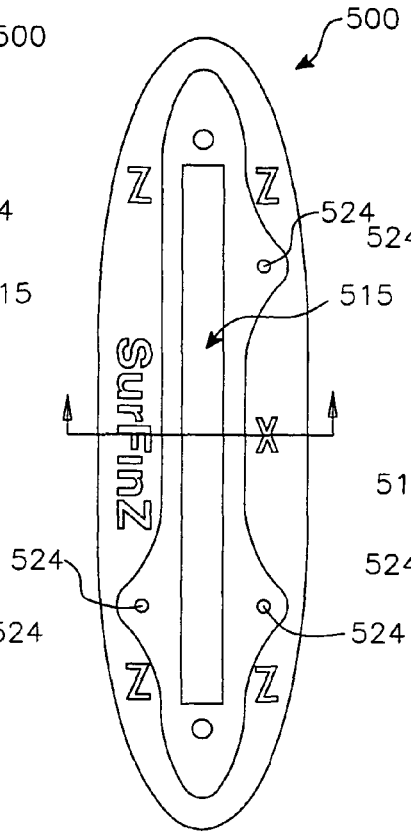
Fig. 12A1
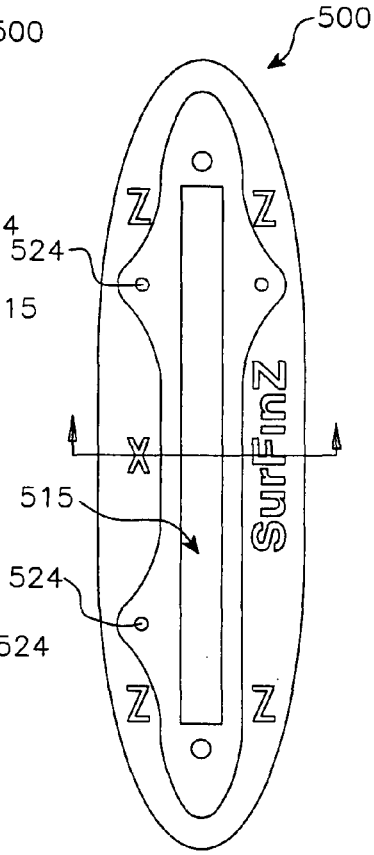
Fig. 12C1
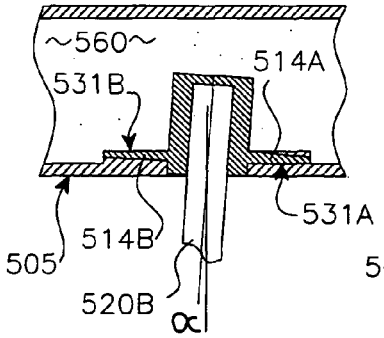
Fig. 12B2
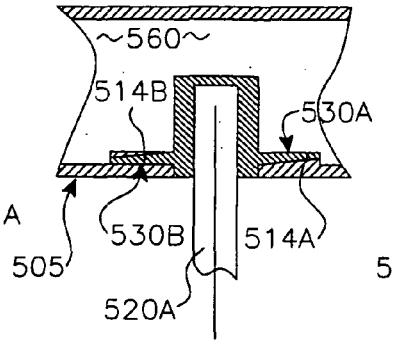
Fig. 12A2
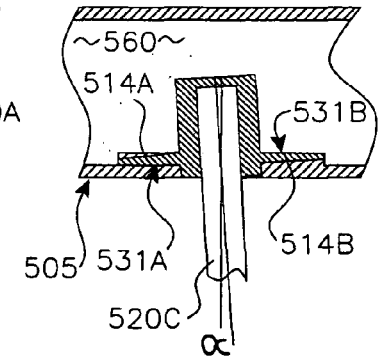
Fig. 12C2

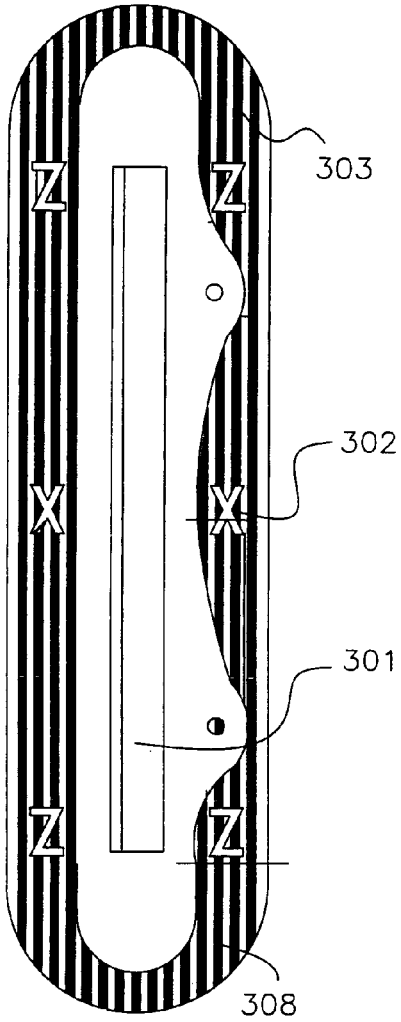
Fig. 14A1
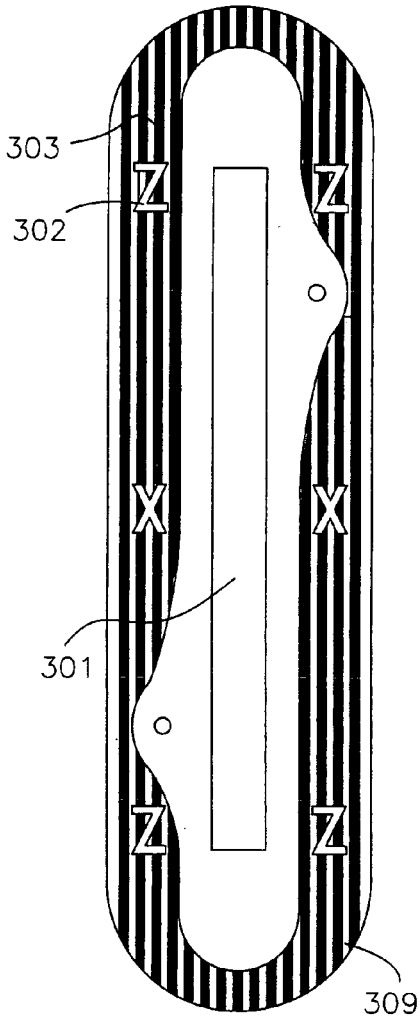
Fig. 14B1
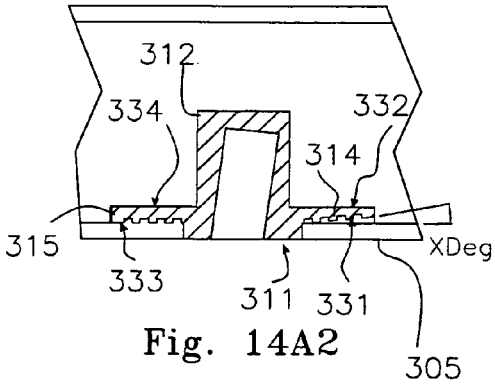
Fig. 14A2
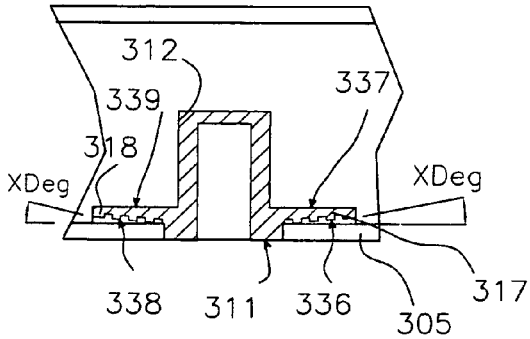
Fig. 14B2

FIN RETENTION SYSTEM FOR A WATER CRAFT

RELATED APPLICATION

This application is continuation-in-part (CIP) of international application PCT/AU2008/001232 filed internationally Aug. 22, 2008, and claims priority to Australian Patent Application 2007/904512 filed on Aug. 22, 2007, the entirety of both these earlier applications are incorporated by reference.

BACKGROUND OF THE INVENTION

1. Field of the Invention

The present invention relates to watercraft, such as surfboards and surf skis, and particularly relates to fins on watercraft.

2. Description of the Background Art

Water craft such as surfboards, surf skis and wind surfers for example, are provided with one or more fins at their underside for stability and to allow a rider better control of direction and manoeuvrability. Many riders prefer certain fin profiles for particular conditions or riding styles so that it has become commonplace to provide such craft with slots capable of accepting interchangeable fins.

The designs of watercraft and specifically surfboards have advanced to include multi-fin systems. The first fin system was a single center fin to enable the basic maneuvering of the board. Developments in the 1980s resulted in the addition of side fins, either as a 3 (tri) fin system comprising a center fin and 2 side fins, or just two side fins (twin). Differing board performance can be achieved by extending the number of fins to 4 fins (quad) that is 2 sets of fins per side.

Of these combinations the one that provides the maximum flexibility is the 5 fin box system, as illustrated in FIG. 13, in that it combines the quad and the tri fin setups. This enables the user to use a standard tri fin set up of a center and a side fin each side, or the alternative of removing the center fin and adding two trailing rear side fins behind the existing side fins of the tri setup to create the quad.

For the tri side fins to provide the required steering characteristics, the inside face of the fin blade is generally flat or has a concave profile. The design of the trailing rear side fins in a 4 fin configuration, differ to the tri side fins, being generally smaller, can be symmetrical double foiled fins, enabling their use in either center or rear side trailing fin positions.

Another characteristic of the trailing rear side fins is that they are generally canted at a smaller angle (typically 2 degrees) than those of the tri Side fins (6 degrees). The fin placement for the tri configuration is well known by the industry, however, when the center fin of the tri configuration is removed and replaced by the two trailing side fins of the quad configuration the relative distance between the two sets of side fins needs to be adjusted for optimum performance.

It would be an advantage to the industry if a standard double foiled symmetrical axial aligned fin with a fin tab arrangement shorter than the length of the fin box slot, containing elongated dual-sided screw receiving slots, enabling the variable adjustment of the fin can be used along with a standard fin box that can be installed at a variable cant angle enabling a single fin and fin box to be used in multiple positions on the board at the time of manufacture.

Another feature particularly of high performance surf boards is that the underside surface of the board is provided with scalloped channels between the center fin and the side fins. These concave formations can cause the edges of the flanges of the fin boxes to protrude through the fiberglass surface of the underside surface of the board.

The present applicant disclosed in WO2006/077470 arrangements of fin boxes adapted to accept a variety of proprietary fin tab configurations.

One problem with fin boxes adapted to accept various fin tab configurations is that the length of slot required is such that distortion of the box may occur when heavy lateral loads are applied to large fins, or when the side retention screws are over tightened. This distortion takes the form of a spreading of the side walls of the slot.

To ensure waterproofing and increased structural strength of the fin box bond to the watercraft core it is preferred to have a layer of re-inforcing cloth to cover the external section of the outer surface of the fin box, and for sections of that surface to be perforated or grooved, to improve the resin bond to the fin box.

A disadvantage with the fixing of a fin box into the core of a water craft is that in some fin box installations a cavity is cut through the outer glassed surface of the board. This causes some inherent weakness as there is no direct bond between the fin box and the glassed surface.

A common feature of systems which provide for interchangeable fins to be retained within a fin box is the securing of the fin tab in the fin box by means of one or more grub screws. Such screws are generally provided with a hexagon drive socket at one end and threaded for their entire length. A problem with this arrangement is that it is easy for a user, anxious not to lose a fin from the box, to over-drive the screw with the associated risk of damage to the fin tab and/or the fin box, or even of stripping the thread of the screw hole within the fin box.

The fin box disclosed herein addresses or at least ameliorates all or some of the above disadvantages.

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

In this specification, terms such as upper, under, lower and vertical etc. refer to surfaces and directions when a water craft is oriented for use with its median plane substantially horizontal.

SUMMARY OF THE INVENTION

A fin attachment system for a water craft is disclosed including a fin box adapted for insertion and releasable attachment of a fin to an underside of said craft; said fin box comprising a body portion provided with at least one elongate slot open at a first surface of said body, and extending to the closed base of the body portion, said fin box further comprising a peripheral flange; a first surface of said flange forming a continuation of said first surface of said body; said fin box characterised by a tapered flange arrangement allowing use of said fin box for each of a central vertical fin and a left side and right side canted fin, wherein a first surface of at least one flange side forms an angle of taper with a axial median plane of said body portion.

The fin attachment system for a water craft may include a fin box adapted for insertion and releasable attachment of a fin to an underside of said water craft; said fin box comprising a body portion provided with at least one elongate slot open at a first surface of said body, and extending to the closed base of the said body portion, said fin box further provided with a peripheral flange extending outwardly from said body portion at said first surface, a first portion of said flange defining an area of said first surface around said elongate slot, a second portion of said flange defining a second lower surface and a third upper surface, both said second and third surfaces offset vertically from said first surface and extending laterally from said body portion, said second lower surface and said third upper surface further comprising a left and right side, each said left and right side surfaces extending transversely from the said body portion to the peripheral extremities of said peripheral flange, said fin box further characterised by a tapered flange arrangement allowing use of said fin box for each of a central vertical fin and a left side and right side canted fin, wherein at least one surface of said peripheral flange forms a transverse angle of taper with an axial median vertical plane of said body portion, said transverse angle of taper being uniformly distributed across the width of at least one of the said surface areas of said peripheral flange.

The body portion of said fin box may be inserted into a body portion recess machined into a core of said water craft; said peripheral flange nesting in a peripheral recess machined around said body portion recess.

The fin box may have a vertical slot and be inserted into a core of said water craft for a central fin, has an upper surface of a peripheral first flange side forming an angle of taper with said axial median plane of said body portion; and an upper surface of the peripheral second opposite flange side, forming an angle of taper with said axial median plane of said body portion; an under surface of said first flange side forming an angle of taper with said axial median plane of said body portion, and an under surface of said second flange side forming an angle of taper with said axial median plane of said body portion.

A fin box is disclosed herein with a vertical slot, inserted into a core of said water craft for a central fin, has an upper surface of said peripheral first flange side forming an angle of taper with said axial median plane of said body portion; and an upper surface of said peripheral second opposite flange side, forming a right angle with a axial median plane of said body portion; said upper surface of second opposite flange side abutting a surface of said peripheral recess; said under surface of said opposite second flange side forms an angle of taper with said axial median plane of said body portion said fin box being in said first fore/aft orientation.

The a fin box with a vertical slot is inserted at an angle into a core of said water craft for a left side canted fin, has an upper surface of said peripheral first flange side forming an angle of taper with said axial median plane of said body portion; said upper surface abutting a surface of said peripheral recess; said under surface of said opposite second flange side forms an angle of taper with said axial median plane of said body portion, said under surface abutting an inner surface of said glassed skin of said water craft; said fin box being in said first fore/aft orientation.

A fin box with a vertical slot is inserted at an angle into a core of said water craft for a right side canted fin, has an upper surface of said peripheral first flange side forming an angle of taper with said axial median plane of said body portion; said upper surface abutting a surface of said peripheral recess; said under surface of said opposite second flange side forms an angle of taper with said axial median plane of said body portion; said under surface abutting an inner surface of said glassed skin of said water craft; said fin box being in a second opposite fore/aft orientation.

A fin box with a canted slot is inserted vertically into a core of said water craft for a left side canted fin, said peripheral first flange side has an upper surface forming a right angle with said axial median plane of said body portion; said upper surface abutting a surface of said peripheral recess; said under surface of said opposite second flange side forms an angle of taper with said axial median plane of said body portion; said under surface abutting an inner surface of said glassed skin of said water craft; said fin box being in said first fore/aft orientation.

A fin box with a canted slot is inserted vertically into a core of said water craft for a right side canted fin, said peripheral first flange side has an upper surface forming a right angle with said axial median plane of said body portion; said upper surface abutting a surface of said peripheral recess; said under surface of said opposite second flange side forms an angle of taper with said axial median plane of said body portion, said under surface abutting an inner surface of said glassed skin of said water craft; said fin box being in a second opposite fore/aft orientation.

A fin box with a vertical elongate slot, with the said body portion inserted vertically into a core of said water craft for a central fin, has a said third upper right side surface of said peripheral flange forming an angle of taper with said axial median plane of said body portion; and a said third upper left surface of said peripheral flange, forming a right angle with said axial median plane of said body portion; said third upper left side surface abutting a surface of said peripheral recess; a said second lower left side surface of said peripheral flange forms an angle of taper with the said axial median plane of said body portion, said fin box inserted into the core of the said watercraft in a first fore/aft orientation.

A fin box with a vertical elongate slot, with said body portion inserted at an angle into a core of said water craft for a right side canted fin, has a said third upper right side surface of said peripheral flange forming an angle of taper with said axial median plane of said body portion; said third upper right side surface abutting a surface of said peripheral recess; a second lower left side surface of said peripheral flange forms an angle of taper with said axial median plane of said body portion, said second lower left side surface abutting an inner surface of the glassed skin of said water craft; said fin box inserted into the core of the said watercraft in said first fore/aft orientation.

A fin box with a vertical elongate slot, with said body portion inserted at an angle into a core of said water craft for a left side canted fin, has a third upper left side surface of said peripheral flange forming an angle of taper with said axial median plane of said body portion; said third upper left side surface abutting a surface of said peripheral recess; a second lower right side surface of said flange forms an angle of taper with said axial median plane of said body portion; said second lower right side surface abutting an inner surface of said glassed skin of said water craft; said fin box being in a second opposite fore/aft orientation.

A fin box with a vertical elongate slot, with said body portion is inserted into a core of said water craft for a central fin or a side fin, has a third upper right side surface of a peripheral flange forming an angle of taper with said axial median plane of said body portion; and a said third upper left side surface of the said peripheral flange, forming an angle of taper with said axial median plane of said body portion; a second lower right side surface of said peripheral flange forming an angle of taper with said axial median plane of said body portion, and a second lower left side surface of said peripheral flange forming an angle of taper with said axial median plane of said body portion, said fin box inserted into the core of the said watercraft in either the first or second fore/aft orientation.

A fin box with a canted elongate slot, with said body portion inserted vertically into a core of said water craft for a right side canted fin, has a said third upper left side surface of said peripheral flange forming a right angle with said axial median plane of said body portion; said third upper left side surface abutting a surface of said peripheral recess; a second lower left side surface of said peripheral flange forms an angle of taper with said axial median plane of said body portion; said second lower left side surface abutting an inner surface of said glassed skin of said water craft; said fin box being in said first fore/aft orientation.

A fin box with a canted elongate slot, with said body portion is inserted vertically into a core of said water craft for a left side canted fin, has a said third upper right side surface of said peripheral flange forming a right angle with said axial median plane of said body portion; said third upper right side surface abutting a surface of said peripheral recess; a second lower right side surface of said peripheral flange forms an angle of taper with said axial median plane of said body portion, said second lower right side surface abutting an inner surface of said glassed skin of said water craft; said fin box being in a second opposite fore/aft orientation.

A fin box with a canted elongate slot, with said body portion is inserted at an angle into a core of said water craft for a right side canted fin, has a said third upper left side surface of said peripheral flange forming an angle of taper with said axial median plane of said body portion; said third upper left side surface abutting a surface of said peripheral recess; a second lower left side surface of said peripheral flange forms an angle of taper with said axial median plane of said body portion; said second lower left side surface abutting an inner surface of said glassed skin of said water craft; said fin box being in said first fore/aft orientation, the said fin box when rotated in a second opposite fore/aft orientation used as a left side canted fin.

A fin box with an associated tapered flange may include a body portion and at least two elongated slots, said slots separated by a transverse strengthening rib; said strengthening rib extending substantially the depth of said slots.

The fin box with an associated tapered flange may also include a body portion and at least two elongated slots, said slots separated by a transverse strengthening rib.

A fin attachment system for a water craft includes a fin box with a tapered flange, a fin having a foil section and a fin tab section, said fin suitable for insertion, releasable attachment and securable positioning within the said elongated slot of the said fin box, said fin is retained in a said elongate slot by at least one screw driven through at least one angled screw hole extending from a first surface of said fin box to at least one internal surface of said elongate slot; said screw engaging with a fin tab of a fin inserted in said elongate slot.

The fin may have a fin tab or multiple fin tabs, the overall length of any combination of said fin tab(s) being shorter than the overall length of the said elongate slot of the said fin box, said fin tab of the said fin contains elongated screw retaining recesses on both sides of the said fin tab, allowing the fin to be inserted into the said elongate slot of the said fin box, and adjusted in a longitudinal direction within the said elongate slot; said fin tab of said fin secured by the said angular screw emerging within the said elongate slot and abutting the said elongated screw retaining recess of the fin tab in the adjusted position.

The screw may be a stainless steel screw, and include an unthreaded head portion and a threaded shank portion.

The at least one angled hole may include a threaded portion and a recessed portion slightly larger than the root diameter of said threaded portion. The recessed portion may be adapted to accommodate said unthreaded head portion of a said screw; said screw and said recessed portion arranged so as to limit the extent to which said screw may be driven through said hole.

The fin tab of the said fin may contain screw retention recesses on both sides of the said fin tab, said headed screw when inserted into the dual diameter multi-level angled threaded retention hole, securely holds the said fin tab of the said fin in position at a pre-determined position within said elongated slot within said fin box, wherein the said headed screw emerges within the said elongate slot and abuts the said screw retaining recess of the fin tab; the head of the said headed screw remaining embedded below the first surface of the body portion whilst securing the fin to the fin box and to the water craft when seated in the said dual diameter multi-level angled threaded retention hole and abutting the said fin tab.

The peripheral flange may contain a perforated trademark, logo or identifying symbol located on the lateral side of the said peripheral flange. The peripheral flange may further contain grooves on the surface of the said peripheral flange.

BRIEF DESCRIPTION OF THE DRAWINGS

FIGS. 12A to 12C show fin insertion sides and cross sections of the fin boxes of FIGS. 11A and 11B arranged at a central and left and right fin positions.

FIG. 14A shows fin insertion side and end cross sectional views of a side fin box with a canted slot, arranged with a single outwardly extending tapered flange surface containing grooves and perforations, FIG. 14B shows fin insertion side and cross section of a center fin box, arranged with two outwardly extending tapered flange surfaces containing grooves and perforations.

FIGS. 15A and 15C contain a single tapered flange as in FIG. 14A, FIG. 15B contains a double tapered flange as in FIG. 14B, and FIG. 15D shows the fin boxes arranged respectively in left, right and central fin positions of a water board.

DESCRIPTION OF THE PREFERRED

The fin boxes disclosed herein typically comprise a body portion consisting of a generally rectangular block in which is provided at least one elongate slot extending from a fin insertion side to the closed base, (or upper portion when installed and in use) of the block.

Additionally, the fin box can comprise a peripheral flange at or adjacent to the fin insertion side extending outwardly from the body portion. The installation of the fin box into a water craft is by cutting a body portion recess in the core of the craft for the nesting of the body portion, and a peripheral recess to accommodate the flange.

The flange may be offset a little from the fin insertion side surface of the body portion to allow glassing over of the flange to lock the fin box within the underside of the craft, creating a water-proof seal over the fin box and leaving only an area around the slot exposed. Set-screws, driven through angled threaded holes extending from the exposed fin insertion side surface area of the fin box to the inside surface or surfaces of the slot, engage the fin tab(s) of a fin, securing the fin in the slot.

The fin box may include a mid-height center cross-brace to minimizes distortion of the fin box due to over-tightening of side screws. Tapered flanges on the fin box allow the fin box to have multiple orientations for the varying bottom contours on different surfboards. Significantly large perforations in the flange to allow resin around the base of the fin box to pass through the perforations and create a bond with the fiberglass skin of the surfboard surface. Flange surface grooves increase the bonding area for resin saturated fibreglass skin. Dual-diameter screws limit the depth of penetration, (less distortion and damage to fin tabs) and still extend below the surface of the fin box lip.

A fin for a water craft may have fin tabs with elongated slots in some or all sides of the tabs. A mid-height strengthening bar may extend the fin tabs to increase the support of the fin base in the fin box and reduce the risk of breakage of the fin tabs.

First, Second, Third & Fourth Embodiments

Figure 13A:
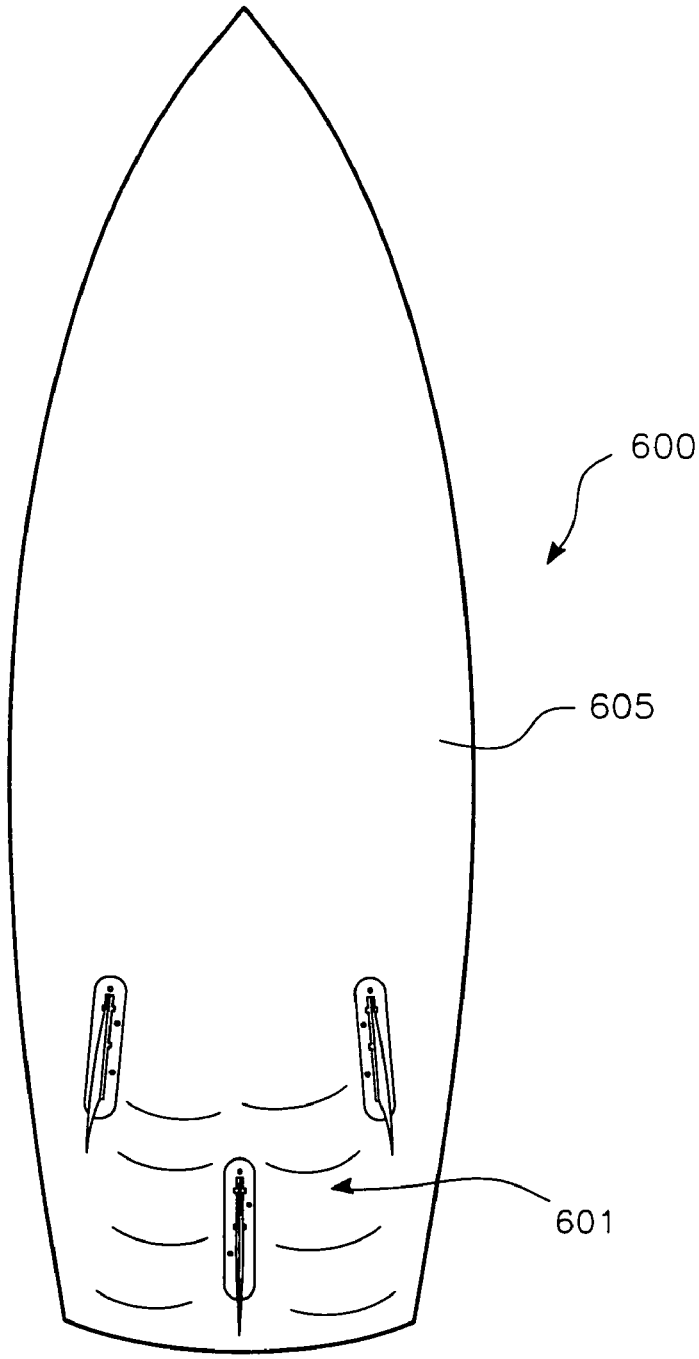
FIGS. 13A and 13B are views of the underside of a water craft showing respectively typical fin locations for a tri fin and a quad fin configuration and concave channels located between the side and center fin positions.
Figure 13B:
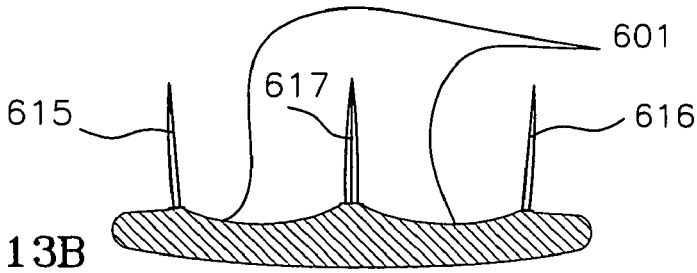

There is a requirement to be able to vary the longitudinal position of all fins and in particular the vertical angle (cant) of the side fins, especially with the new development of multi-fin watercraft, and specifically for 4 and 5 fin box configurations. The major change is that the traditional 3 fin setup has two additional side fins added at the rear between the existing side fins and center fin as illustrated in FIGS. 13A and 13B. This enables a surfer to use a traditional 3 fin setup as illustrated in FIG. 13A or switch to a 4 fin setup (2 sets of side fins) as illustrated in FIG. 13B, by removing the center fin and adding the two rear side fins, to change the performance features of the watercraft.

The side fin cant in a typical tri fin setup is usually 5 to 6 degrees outwardly toward the rail of the watercraft, and can be achieved by either having the cant angle molded into the fin box for accepting a fin with an axially aligned fin tab, or alternatively a fin box with a vertical recess that accepts fins with the fin tab offset at the required cant angle. The former means that the cant angle is fixed within the fin box, whereas with the latter the only option to vary the cant is to change the fin tab offset.

Figure 10A:
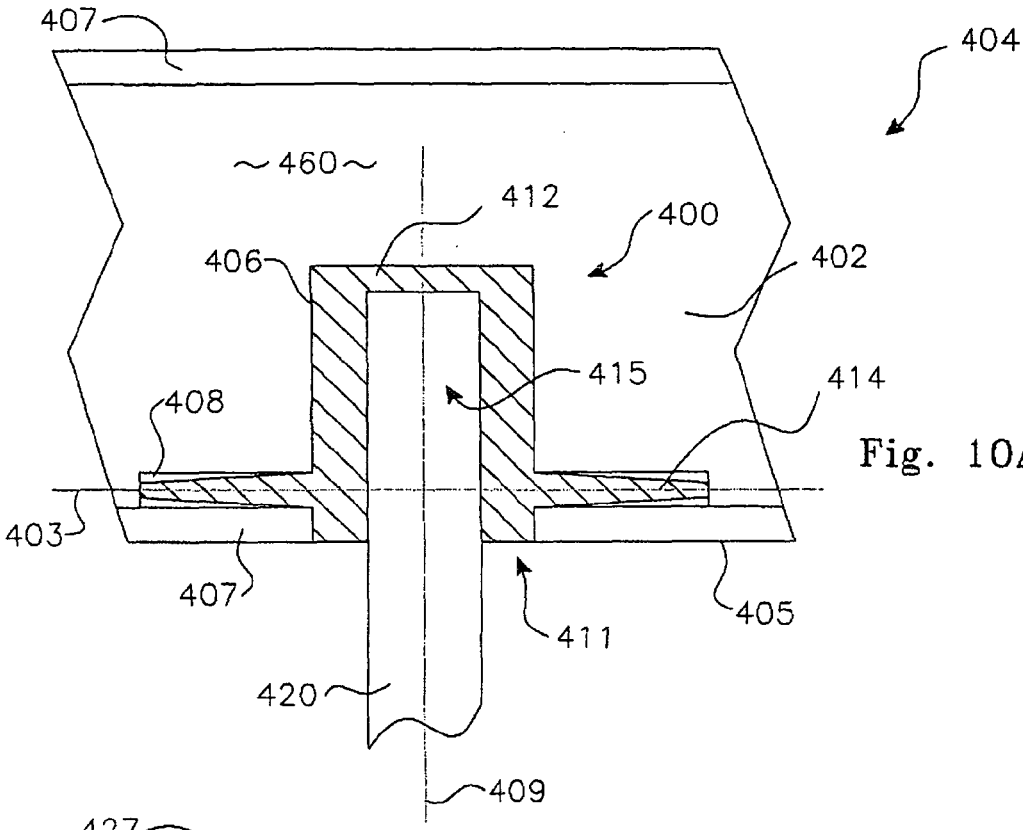
FIG. 10A is a cross sectional view of a fin box, with tapered outwardly extending and symmetrical flanges installed in a water craft with a fin normal to the surface of the craft.
Figure 11A:
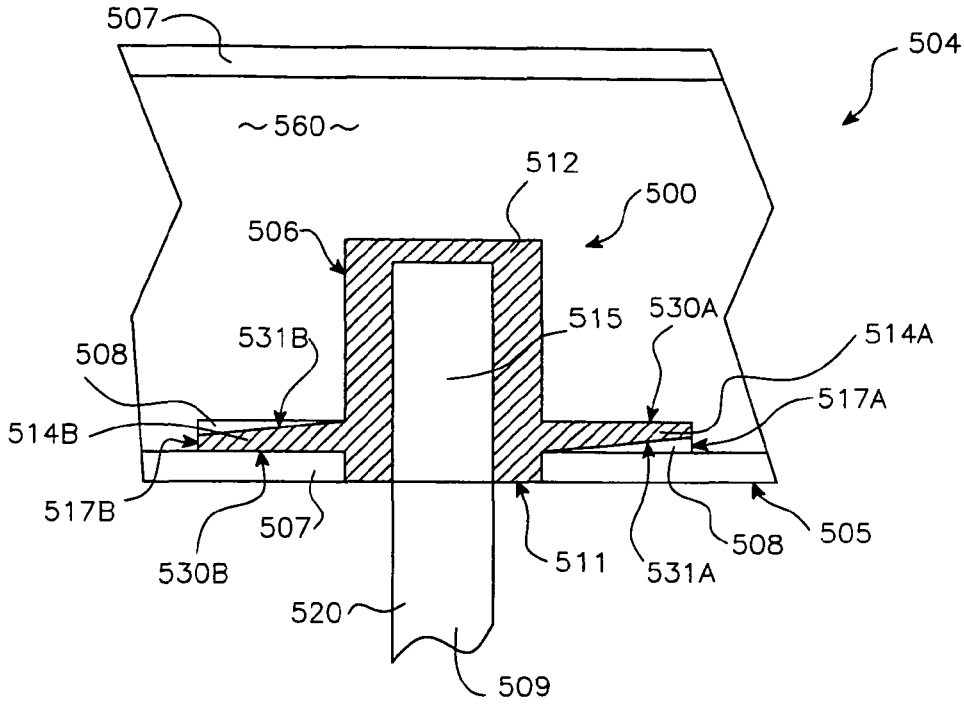
FIG. 11A is a cross sectional view of a fin box with tapered outwardly extending but asymmetrical flanges installed in a water craft with a center fin normal to the surface of the craft.

FIGS. 10A and B and FIGS. 11A and B show cross-sectional views of two preferred embodiments of fin boxes which have tapered flange configurations. The tapering of the peripheral flange allows the cant angle of the fin box itself to be set during installation and using fins with standard axially aligned fin-tabs, so that multiple fin cant angles can be achieved. This is particularly important as typically the rear side fins of a 4 fin setup are at a reduced cant angle of approximately 2 to 3 degrees, thus allowing the same fin box to be used as a centre fin box or a side fin box.

Figure 4:
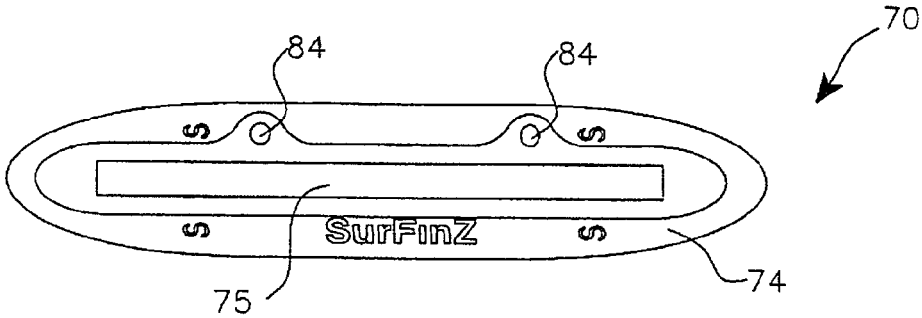
FIG. 4 is a view of the fin insertion side of a first preferred arrangement of fin securing screw hole locations.
Figure 5:
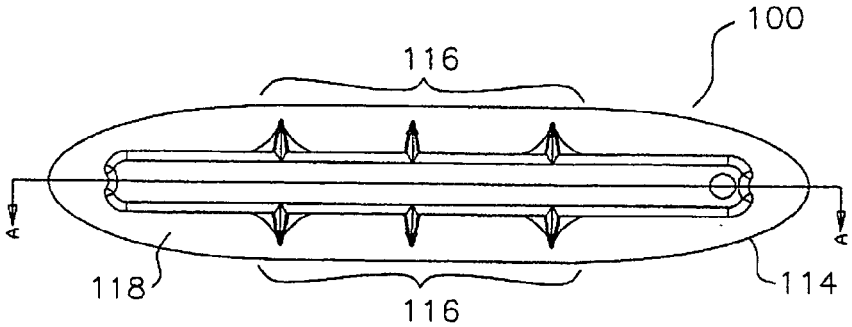
FIG. 5 is an orthogonal view of the upper side of the fin box of FIG. 3.
Figure 6:
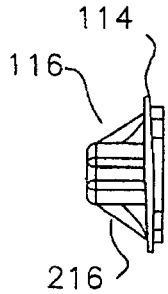
FIG. 6 is an end view of the fin box of FIG. 3.
Figure 7A:
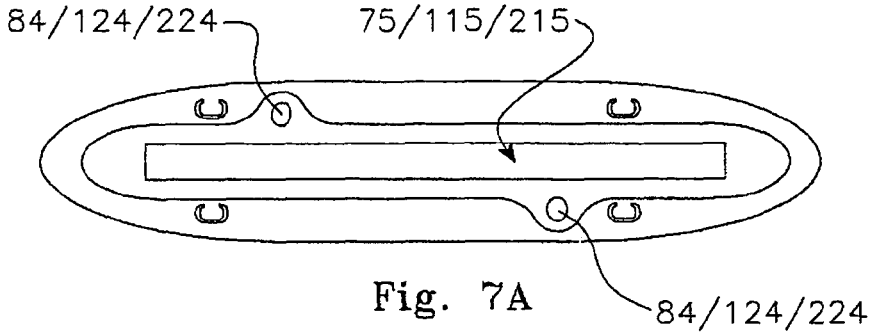
FIG. 7A shows a fin insertion side of a second preferred arrangement of fin securing screw hole locations.
Figure 7B:
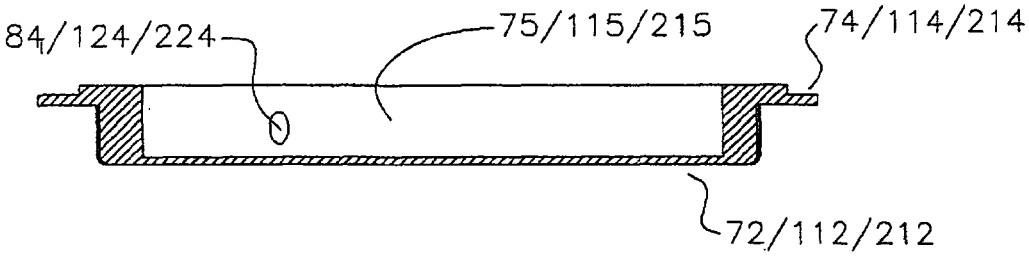
FIG. 7B is a cross sectional view of the fin box shown in FIG. 7A.
Figure 8A:
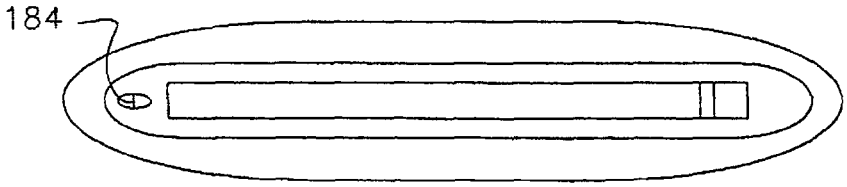
FIG. 8A shows a fin insertion side of arrangement of a fin securing screw hole location, utilising a single end screw hole.
Figure 8B:
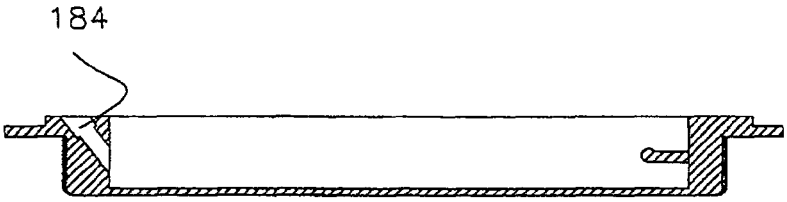
FIG. 8B is a cross sectional view of the fin box of FIG. 8A, showing a single end screw hole configured to take a headed screw.

The tapered flanges also assist in resolving manufacturing issues related to the installation of fin boxes in performance water craft with contoured bottom profiles. Typically the fins are secured with two screws on one side of the flange (for side box installation) and two screws one on each side of the flange for the centre fin box installation or a single end screw as shown in FIGS. 4,7 and 8 respectively. To further facilitate this flexibility, the number of side securing screws to lock a fin in the fin slot can be increased to at least three, as shown in FIG. 12. This is a combination of the existing side and center configurations. A symmetrical configuration of four screws, two on each side accommodates all types of fins in any fin box position, fin tabs containing elongated dual-sided screw receiving recesses facilitate the flexibility of securing any fin with any of the above screw combinations. A perforated identifying mark, such as a trade mark is located on the flange side with the taper on the lower side of the flange, so as to be used as an alignment reference (the perforated mark always adjacent the watercraft rail). Rotating the symmetrical fin box longitudinally allows for left and right side installation, again with the perforated mark adjacent the rail.

Figure 10B:
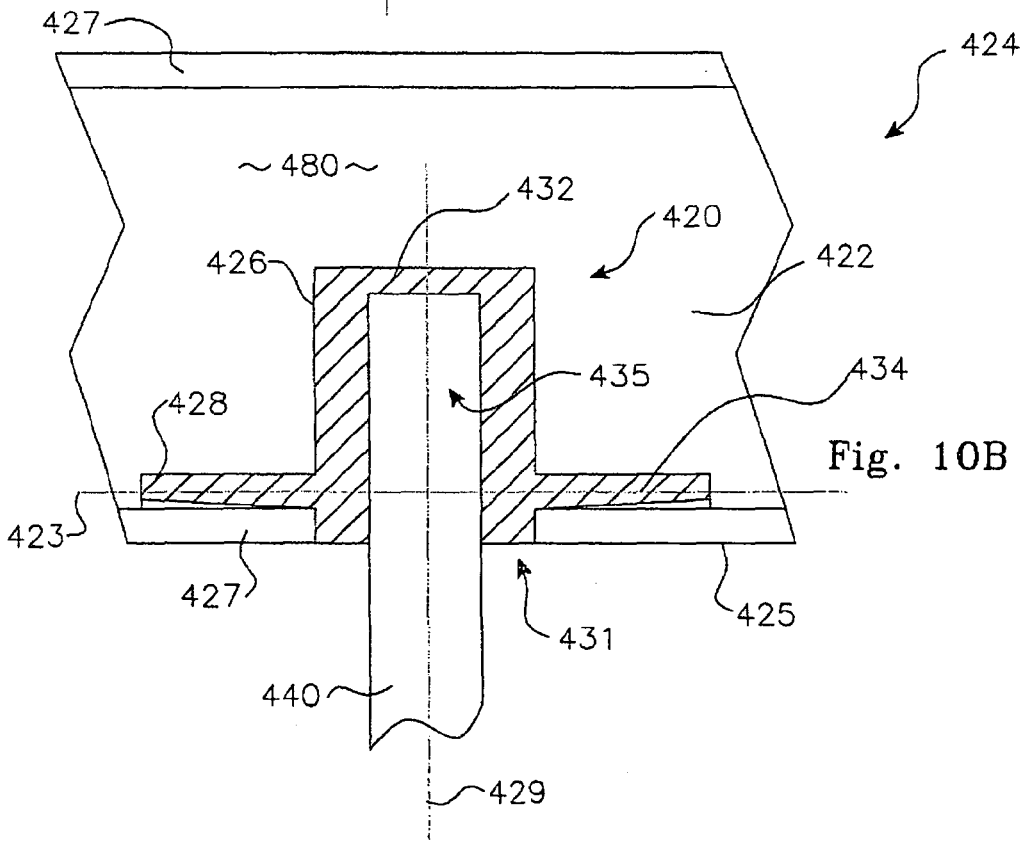
FIG. 10B is a cross sectional view of a fin box with one tapered outwardly extending and symmetrical side flange and one asymmetrical tapered side flange installed in a water craft with a fin normal to the surface of the craft.

The fin box of FIG. 10A has tapers on both top and bottom surfaces of both side flanges, and FIG. 10B has tapers on only the two top surfaces and one bottom surface.

Figure 11B:
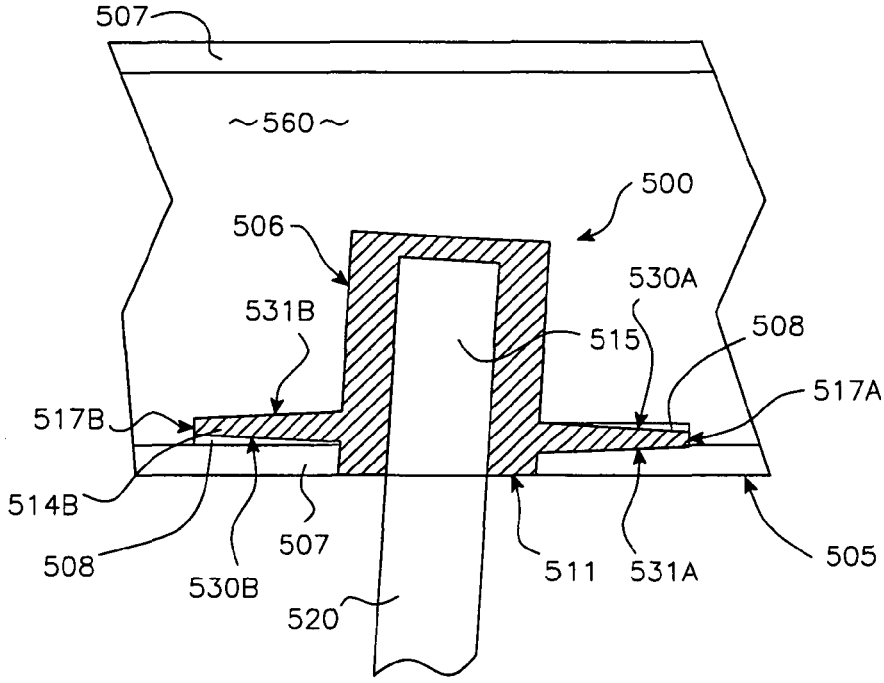
FIG. 11B is a cross sectional views of a fin box with tapered outwardly extending but asymmetrical flanges installed in a water craft at an angle with a left side fin canted to the surface of the craft.

FIG. 11A, shows a vertical centre fin box configuration, the left hand side flange has a taper on top with a flat section on the bottom of the flange, and is the side that contains the perforated mark. The right hand side flange has a taper on the bottom with a flat section on top of the flange. FIG. 11B shows a left side fin box configuration in which the fin box of FIG. 11A is canted toward the outside rail of the watercraft.

FIGS. 12A to C are further embodiments of the fin box 11A. In FIG. 12A, the fin box is in the vertical position for a center installation. Referring to FIG. 12B, for a left side installation, the fin box is angled outwardly toward the left rail; this raises the tapered upper surface of the left side flange up into the flange recess in the foam core. Simultaneously the right side flange rotates down but as the under surface of this flange is tapered, the outside edge of the flange remains below the surface of the glass surface.

Referring to FIG. 12C, for a right side installation, the fin box is rotated longitudinally such that the perforated mark is adjacent the right rail. Again, as the fin box is angled outwardly toward the right rail, the tapered upper surface of the right side flange containing the perforated mark is raised up into the flange recess in the foam core. Simultaneously the left side flange rotates down but as the under surface of this flange is tapered, the outside edge of the flange remains below the surface of the glass surface.

First Embodiment

Figure 1:
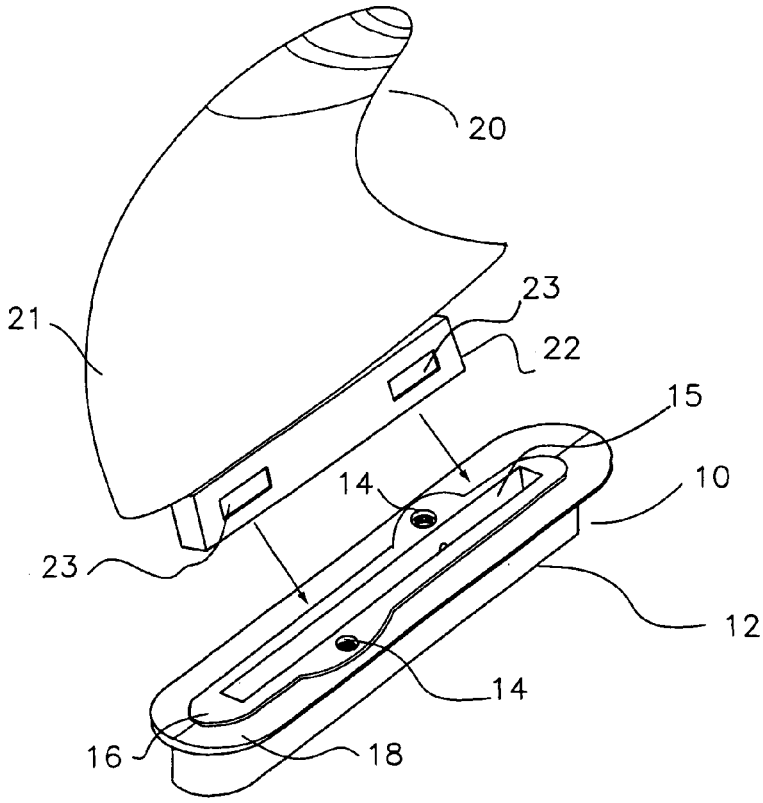
FIG. 1 is a perspective view of a fin box and fin showing a first arrangement of a tapered flange, dual diameter, multi-level angled threaded holes in the fin insertion surface of the fin box and the dual-sided elongated screw receiving slots in the fin tabs of the associated fin.
Figure 2A:
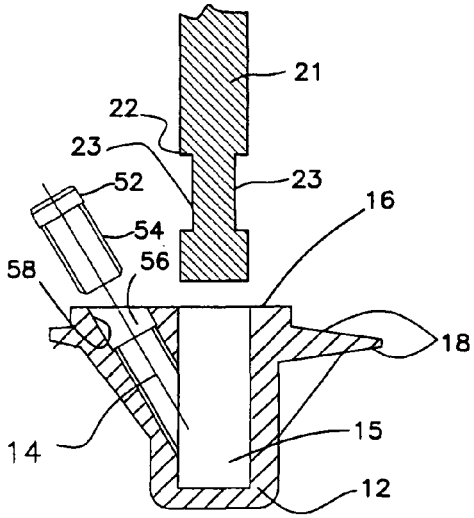
FIGS. 2A and 2B are cross-sectional views of the fin box of FIG. 1 showing the tapered flange, dual diameter multi-level threaded angled holes, the associated headed screw and the fin tabs of the associated fin containing the dual-sided elongated screw receiving slots.
Figure 2B:
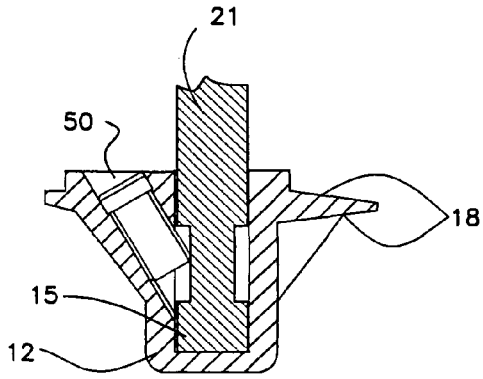
Figure 3:
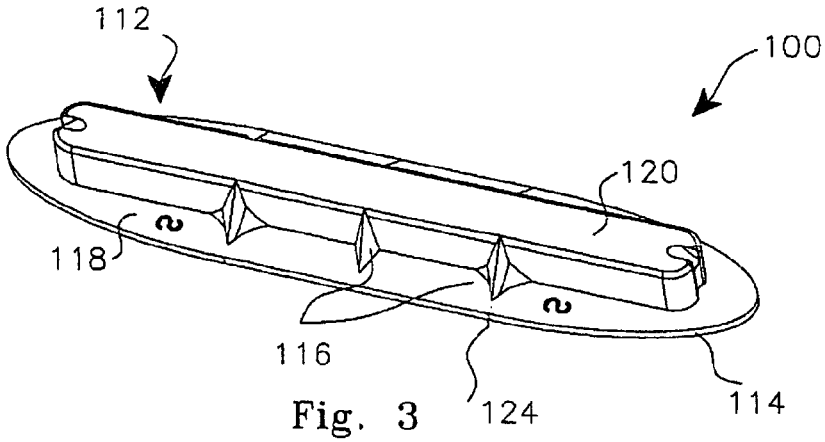
FIG. 3 is a perspective view of a fin box showing a preferred arrangement of strengthening side ribs.

With reference to FIGS. 1, 2A and 2B, a fin box 10 comprises a body portion 12 a slot 15 extending substantially the full length of body portion 12, a fin insertion surface 16, a tapered flange 18, and a pair of angled screw holes 14 located one on each side of the elongate slot.

An associated fin 20, comprising a foil section 21 and a fin tab 22 containing multiple elongated screw retaining recesses 23 on both sides of the fin tab arranged to be co-incident with the angled screw holes.

The fin tab length is shorter than the elongated fin box slot allowing adjustment of the position of the fin within the fin box slot.

Elongated screw retaining recesses on both sides of the fin tab, as shown for various fin tab configurations in FIGS. 21A to 21D facilitate secure connection of the fin to the fin box and surfboard with multiple possible combinations of retaining screws with the fin in the preferred adjusted position.

In a first arrangement of the first embodiment, turning specifically to FIG. 10A, a fin box 400 according to any of the above described embodiments, is shown assembled within the core 402 of a water craft 404. It can be seen that the core 402 of the craft 404 has been provided with a recess 406 adapted to accept the body portion 412 of the fin box 400. Likewise a peripheral recess 408 has been machined to a depth to accommodate peripheral flange 414 to the extent that only the surface 411 of the fin insertion side of body portion 412 is exposed and flush with the outer surface 405 of glassed skin 407. In this instance, the peripheral flange 414 on either side of body portion 412 is symmetrically tapered on all four upper and lower surfaces 416, 417, 418 and 419 and a plane 403 defined by flange 414 is normal to the median axis 409 of the body portion 412, such that a centre fin 420 projects from slot 415 normal to the surface 405.

In a second arrangement of the first embodiment, a fin box 420 according to any of the above described embodiments is shown assembled within the core 422 of a water craft 424. It can be seen that the core 422 of the craft 424 has been provided with a recess 426 adapted to accept the body portion 432 of the fin box 420. Likewise a peripheral recess 428 has been machined to a depth to accommodate peripheral flange 434 to the extent that only the surface 431 of the fin insertion side of body portion 432 is exposed and flush with the outer surface 425 of glassed skin 427. In this instance, the peripheral flange 434 has only three tapered surfaces, the upper first side surface 436, the under first side surface 437 and under second side surface 439.

The second flange side upper surface 438 is at a right angle to the axial median plane 429 of body portion 432, a plane 423 defined by flange 434 is normal to the median axis 429 of the body portion 432, such that a centre fin 440 projects from slot 435 normal to the surface 425.

Second Embodiment

In the second embodiment, with reference to FIG. 11A the peripheral flange sides 514A and 514B of fin box 500 are not symmetrically tapered on either side of body portion 512. Peripheral flange sides 514A and 514B are tapered towards the outer edge 517A and 517B respectively. The upper or first surface 530A of flange side 514A forms a right angle with the side of body portion 512. Similarly the lower or first surface 530B of flange side 514B forms a right angle with the opposite side of body portion 512. The tapering of flange sides 514A and 514B is such that the angle between each of the second surfaces 531A and 531B opposite the first surfaces 530A and 530B respectively, is equal to the angle a between the planes of canted left hand side fin 520B (see FIG. 12B) and canted right hand side fin 520C (see FIG. 12C), and the vertical.

Still with reference to FIG. 11A, the depth of the peripheral recess 508, and the vertical offset between surfaces 530A and 530B, are arranged so that with the fin box inserted into a recess 506 for a central vertical fin 520, upper surface 530A is in contact with the surface of the peripheral recess 508, while lower surface 530B is in contact with the inner surface of glassed skin 507.

Turning now to FIGS. 12A to 12C, in which a three fin arrangement for a surf craft comprises a central fin 520A, a left side fin 520B and a right side fin 520C. It will be noted that the two outer fins 520B and 520C are canted outwardly towards opposing edges (not shown) of the water craft to which they are fitted. This arrangement of a vertical central fin and outwardly canted side fins can be accommodated in the one configuration of a fin box as described above with reference to FIGS. 11A and 11B.

It will be seen in FIG. 12A that the fin box 500 is the same as that of FIG. 11A. The sides of the recess 506 accommodating the body portion 512 of the fin box are normal to the surface 505. The surfaces 530A and 530B (which are at right angles to body portion 512) of opposing flange sides 514A and 514B respectively abutting the surface of the flange recess 508 and inner surface of glassed skin 507, again as previously described.

With reference to FIG. 12B, the fin box 500 is the same as that of FIG. 11A, the recess for the body portion 512 of the fin box is cut into the core 560 normal to the surface of the core. The foam material of the core is sufficiently resilient to allow the canting of the fin box. When the fin box body portion 512 is then fully inserted into its recess, it can be held in its canted position so that after the application of the skin, the upper surface 531B of left hand flange side 514B abuts the surface of the peripheral flange recess, while the under surface 531A of right hand flange side 514A abuts the inner surface of glassed skin 507.

It will be noted from the plan view of the fin boxes for the central location of FIG. 12A and the left hand location of FIG. 12B, that the fin boxes are oriented fore/aft in the same direction, as can be seen by the perforated logo "SurFinz" and the disposition of the securing screw holes 524. The logo in fact serves as a reference guide in that for side fins the fin box is always oriented with the logo towards the rail or outer edge of the craft.

For the canting of fin 520C, again a recess is cut into the core 560 normal to the surface of the core. However in this case, the fin box is turned end for end before insertion, so that the logo "SurFinz" is now at the opposite side of the slot 515. The flange sides 514A and 514B are then also reversed so that it is now the lower surface 531A of flange side 514A which abuts the inner surface of glassed skin 507, while the upper surface 531B of flange side 514B abuts the surface of peripheral recess 508.

By this arrangement of the peripheral flange 514, a single configuration of a fin box can be utilised for the three positions of fins, allowing for a vertical central fin and outwardly canted side fins.

Typically, the maximum angle of canting desirable for the outer fins of a surf craft for a two or three fin arrangement is 6 degrees, while for a four fin arrangement the secondary outer fins (that is the pair of outer fins between the rear end of the craft and the forward outer fins) (see FIG. 13B), is 2 degrees. It will be understood that the arrangement of the tapered peripheral flange as described for the present embodiment allows a fin box to be canted to any angle between 0 degrees and the angle of taper which preferably is 6 degrees.

It will readily understood that conversely the flange tapers can be reversed if the market requires the side fins to be secured by screws on the opposite side (rail side flange) of the fin box.

Third Embodiment

Figures 15A, 15B, 15C:
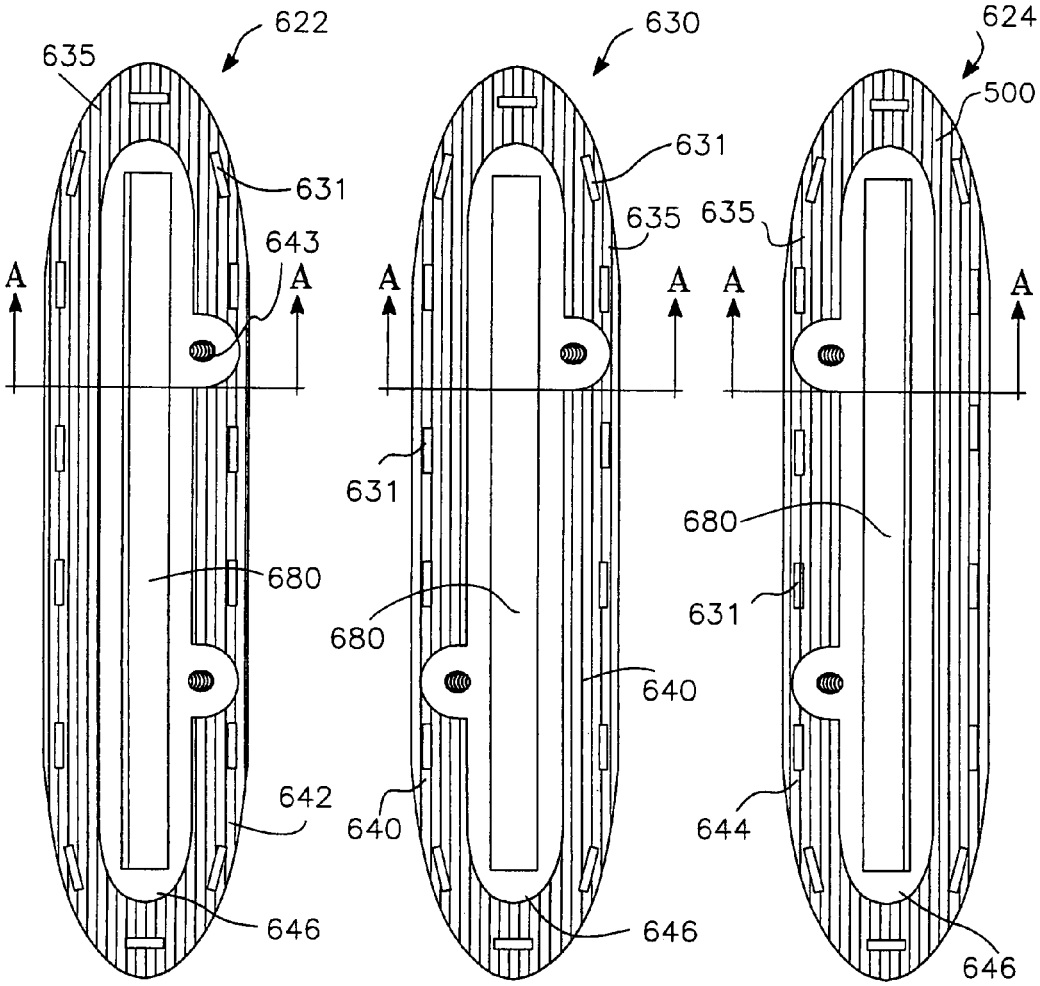
FIGS. 15A to 15D show fin insertion sides and cross sections of the fin boxes of FIGS. 14A and 14B. These figures show differing flange taper configurations of fin boxes with grooved and perforated flanges.
Figure 15D:
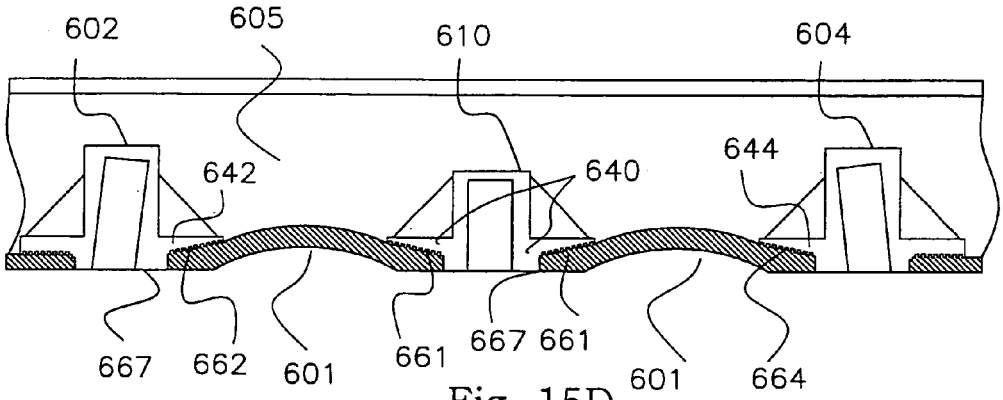

As shown in FIGS. 13A and 15A, B, C and D, a feature particularly of high performance surf boards is that the underside surface of a board 600 is provided with scalloped channels 601 between the center fin 617 and the two side fins 615 and 616. If a fin box with a canted slot is installed in the normal vertical position there is a risk that the lower flange surfaces of the center fin box and at least one of the inside lower flange surfaces of each of the left and right hand fin boxes, may protrude through the fiberglass surface of the underside of the board.

FIG. 14A shows in detail a fin insertion side and cross section of a fin box 308 with a canted slot, according to a third embodiment, installed in the normal vertical position and arranged as a side fin box with a single outwardly extending tapered flange surface containing grooves 303 and perforations 302.

In this third embodiment, a fin box installed to accept a left side fin, has only the lower surface 331 of the right side peripheral flange 314 tapered towards its outer edge. The upper surface 332, of flange side 314 forms a right angle with the side of body portion 312. Both the lower and upper surfaces 333 and 334 of the left side flange 315 also form right angles with the opposite side of body portion 312. The tapering of flange side 314 is at an angle (X Degrees) equivalent to the angle created by the concave channel. Rotating this fin box will provide a fin box for a right side fin.

Fourth Embodiment

FIG. 14B shows a fin insertion side and cross section of a fin box 309, according to a fourth embodiment arranged as a center fin with two outwardly extending tapered flange surfaces containing grooves 303 and perforations 302.

Still with reference to FIG. 14B, the peripheral flange sides 317 and 318 on either side of body 322, have both their lower surfaces 336 and 338 tapered towards their respective outer edges. Both their upper surfaces 337 and 339 form right angles with the side of body portion 312.

FIGS. 15A, B, C and D exhibit the use of these embodiments to enable the fin box to be installed in a vertical alignment and eliminate the issues associated with channels in the bottom of surfboards.

In FIG. 15B both underside surfaces 661 of the peripheral flanges 640 of the central fin box 630 are angled away from surface 667, so as to ensure that the flange remains under the outer skin of the board. Similarly, in FIGS. 15A and C the inward facing underside surfaces 662 and 664 of the flanges 642 of the left hand and 644 of the right hand fin boxes 622 and 624 respectively are also angled away from surface 667, whilst the upper surfaces of all the flanges remain at right angles to the fin box body portions 602, 610 and 604.

The underside portion of the peripheral flanges 640, 642 and 644 are provided with a plurality of surface grooves 635 and apertures 631, distributed at intervals around the recess 680 (also shown as grooves 303 and perforations 302 in FIGS. 14A and B around recess 301). These apertures are adapted to allow passage through the apertures of resin or bonding agent and any trapped air, additionally the surface grooves increase the bonding strength of the flange to the external fiber glass skin, thereby increasing the retention strength of the fin box to the foam core of a surfboard when lateral and axial forces act on a fin inserted in the fin box.

Fifth Embodiment

In a fifth embodiment FIGS. 9A to D show arrangements for the strengthening of a fin box to reduce distortion in the fin box as a result of lateral forces applied to a fin tab of a fin (not shown) inserted into the fin box, secured by screws driven through angular threaded screw holes 220A and 220B and emerging within elongated slots 240A and 240B.

Figure 9A:
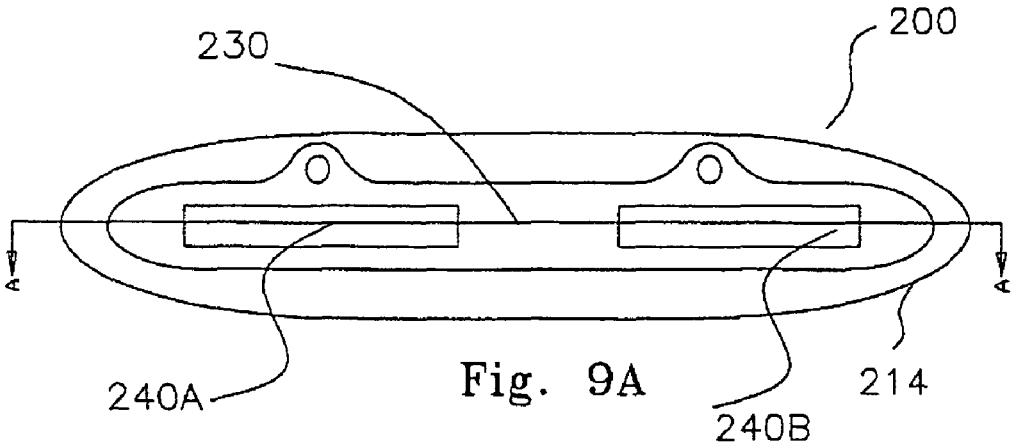
FIGS. 9A and 9B are a fin insertion side and cross section view of a first preferred arrangement for reinforcing the slot of the fin box.
Figure 9B:
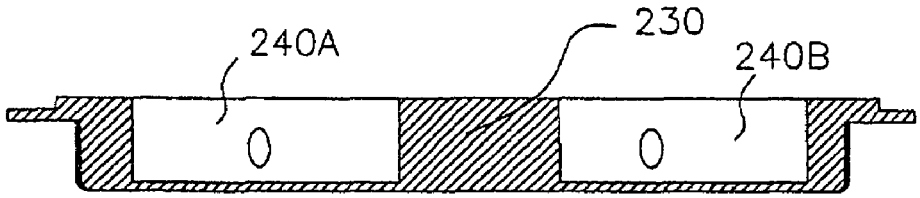

In a first arrangement of the fifth embodiment with reference to FIGS. 9A and 9B a fin box 200 comprises a recess that is divided into two sections by divider portion 230, effectively forming two longitudinally aligned recesses 240A and 240B, that contain angular threaded screw holes 220A and 220B that accept fin securing screws.

Figure 9C:
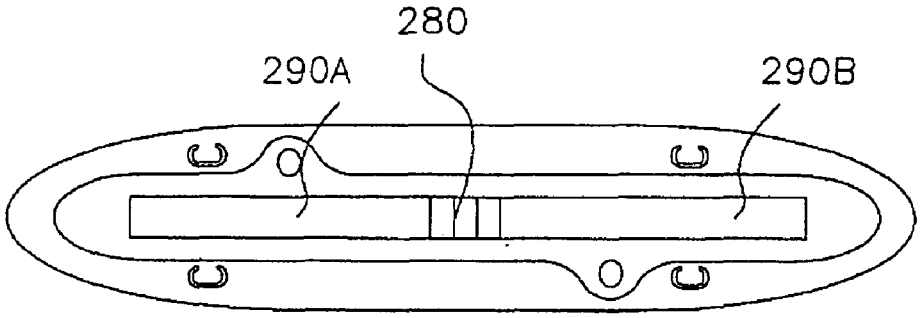
FIGS. 9C and 9D show a fin insertion side and a cross sectional view, respectively, of reinforcing for the slot of the fin box.
Figure 9D:
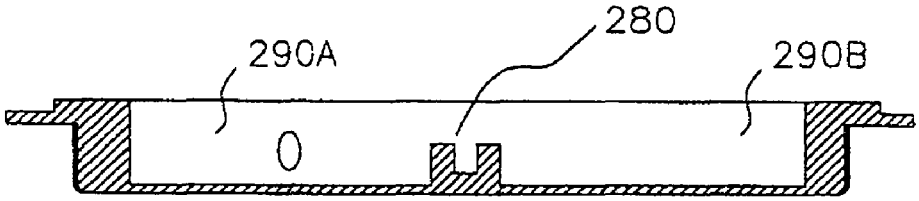

In a second arrangement of the fifth embodiment with reference to FIGS. 9C and 9D, a fin box 250 comprises a recess that is divided into two sections by divider portion 280, effectively forming two longitudinally aligned recesses 290A and 290B, also containing angular threaded screw holes 270A and 270B that accept fin securing screws; in this arrangement the divider portion 280 partially fills the recess.

An advantage of these particular arrangements of the fin box is that there is a considerable strengthening of the box compared with that of a single continuous recess.

Sixth Embodiment

With reference to FIGS. 1, 2A and 2B, a fin box 10 according to the sixth preferred embodiment, comprises a body portion 12 a slot 15 extending substantially the full length of body portion 12, a fin insertion surface 16, a tapered flange 18, and in this embodiment a pair of dual diameter multi-level angled screw holes 14 located one on each side of the elongate slot.

An associated fin 20, comprising a foil section 21 and a fin tab 22 containing multiple elongated screw retaining recesses 23 on both sides of the fin tab arranged to be co-incident with the angled screw holes.

The fin tab length is shorter than the elongated fin box slot allowing adjustment of the position of the fin within the fin box slot and ensuring secure connection of the fin to the fin box and surfboard by the headed screw 50.

Headed screw 50, as shown in FIGS. 2A and 2B is the preferred screw securing system, which is formed with an unthreaded head portion 52 and a threaded shank portion 54.

Threaded hole 14 as shown in FIG. 2A, is formed with a plain sided recess section 58, to a depth sufficient to allow the head portion 52 to be below the level of the fin box insertion surface 16 as seen in FIG. 2B. The diameter of the recess section 58 is such as to provide a close sliding fit with the head portion 52 of the screw 50. The threaded shank portion 54 is of a length sufficient to lock a fin 21, shown with screw recesses 23 in both sides of the fin tab, in the fin box slot 15 without applying excessive force on the fin tab of the fin so as to prevent damage to the fin or to the fin box itself.

In the illustrated example of FIG. 2B the unthreaded head portion 52 is of a diameter larger than the root diameter of the threaded shank portion 54, thereby limiting the extent to which the screw can be driven into the threaded hole and thus prevent damage to fin tabs and the fin box.

A user of a board with one or more fin boxes as described herein may interchange a variety of preferred fins simply by selecting the fin, inserting it into the fin box and securing it. As shown in FIGS. 16 to 20 a preferred screw securing system includes stainless screws 850, which are formed with an unthreaded head portion 852 and a threaded shank portion 854.

Figure 17:
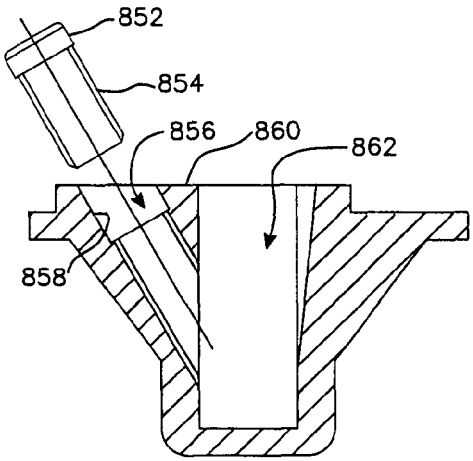
Figure 18:
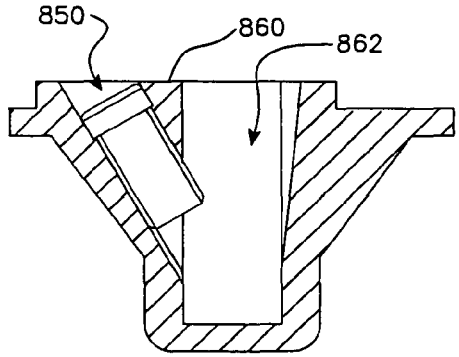

Threaded hole 856 as shown in FIG. 17, is formed with a plain sided recess section 858, to a depth sufficient to allow the head portion 852 to be below the level of the fin box outer surface 860 as seen in FIG. 18. The diameter of the recess section 858 is such as to provide a close sliding fit with the head portion 852 of the screws 850. The threaded shank portion 854 is of a length sufficient to lock a fin (not shown) in the fin box slot 862 without applying excessive force on the fin tab of the fin so as to prevent damage to it or to cause damage to the fin box itself.

Figure 16A:
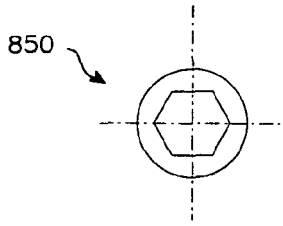
FIGS. 16 to 20 show cross-sectional views of two alternative arrangements of the headed screw securing system.
Figure 16B:
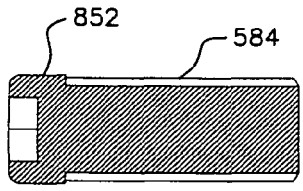

In the illustrated example of FIG. 16 the unthreaded head portion 852 is of a diameter larger than the root diameter of the threaded shank portion 854, thereby limiting the extent to which the screw can be driven into the threaded hole and thus prevent damage to fin tabs and the fin box. The unthreaded head portion 852, contains a hexagon slot for the use of a standard Allen key, but can be various other configurations such as a Phillips head or straight slot interface.

Figure 19:
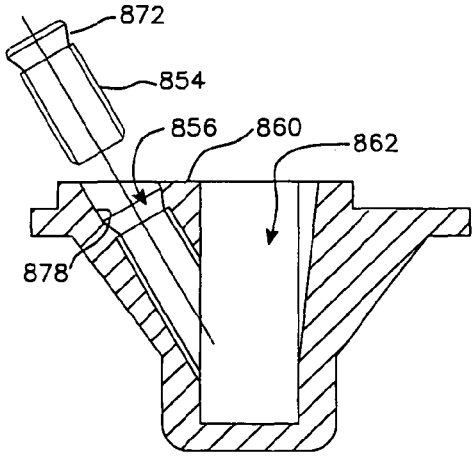
Figure 20:
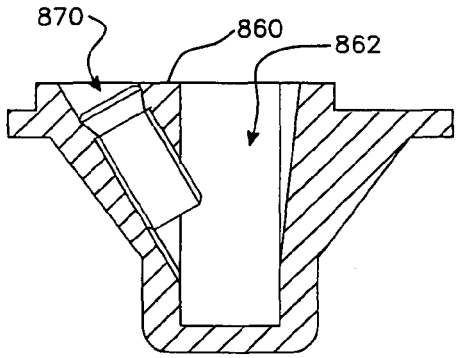
Figure 21A:
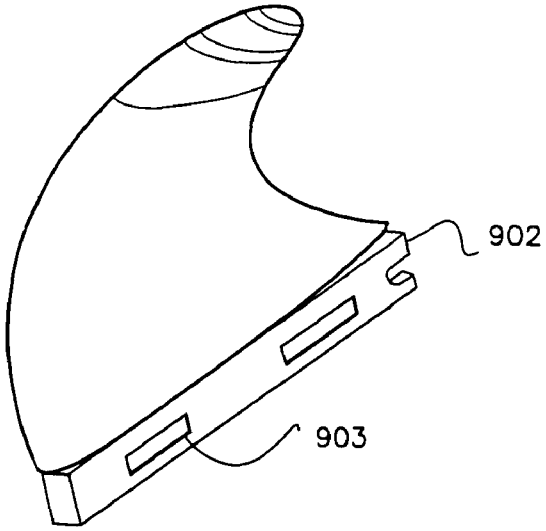
FIGS. 21A to D show perspective views of four fin and fin tab configurations having dual-sided elongated screw receiving slots, able to be fitted to preferred embodiments of the fin attachment system or fin box.
Figure 21B:
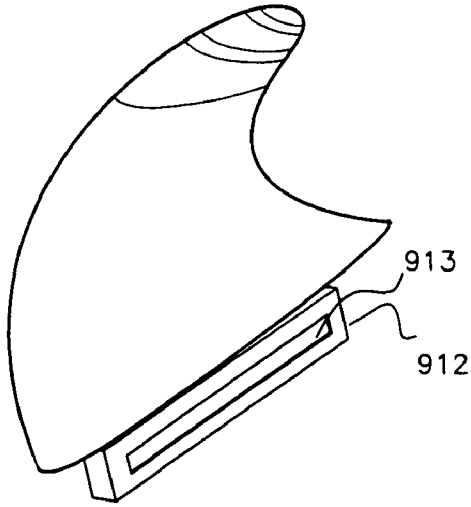
Figure 21C:
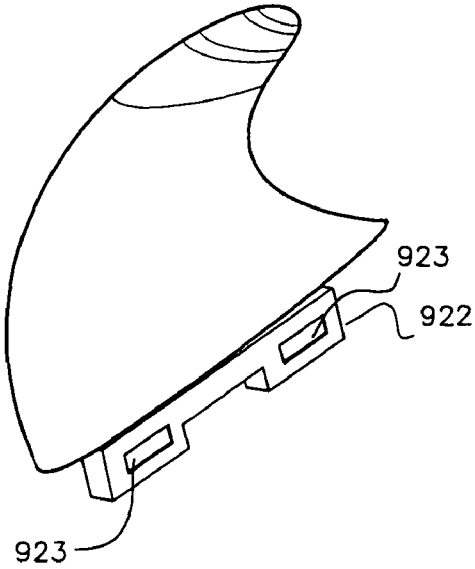
Figure 21D:
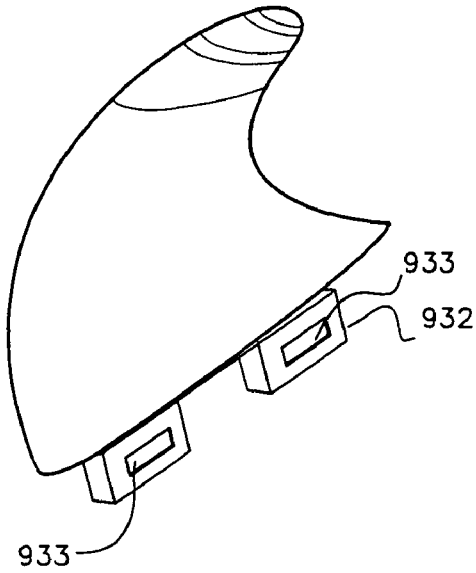

FIGS. 19 and 20 show a further embodiment using a countersunk unthreaded head section of the screw.

While the invention has been described in detail, the foregoing description is in all aspects illustrative and not restrictive. It is understood that numerous other modifications and variations can be devised without departing from the scope of the invention.

I claim:

1. A fin box to be inserted in an underside of a water craft and for releaseably attaching a fin to the water craft, said fin box comprising:

a body portion including a left sidewall, a right sidewall and an elongated slot between the left and right sidewalls, wherein the elongated slot is open at a first surface of said body portion and said elongated slot extends down between the sidewalls to a base in the body portion, wherein the base extends between the left and right sidewalls, and the extended slot has a median plane extending the length of the extended slot;

a peripheral flange extending transversely from said body portion, a first portion of said flange defining an area of said first surface around said elongated slot;

a second portion of said flange including a second lower surface and a third upper surface, said second surface and third surface are both offset from said first surface towards the base, and the second portion extends transversely from said body portion, wherein the second portion includes a left side extending transversely from the left sidewall and a right side extending transversely from the right sidewall, and said second lower surface and said third upper surface each extends to a peripheral extremity of said peripheral flange;

wherein at least one of the second lower surface and the third upper surface of said peripheral flange is tapered at a transverse angle with the median plane, said taper being uniformly distributed across a width of at least one of the surfaces of said second portion of the peripheral flange.

2. The fin box of claim 1 wherein said body portion of said fin box is configured to be inserted into a body portion recess in a core of said water craft and said peripheral flange is configured to nest in a peripheral recess around said body portion recess.

3. The fin box of claim 1 wherein:

said third upper surface of the right side of the second portion of the peripheral flange forms the transverse angle of taper with said median plane of said body portion, and said third upper surface of said left side of the second portion -forms a right angle with the median plane;

said third upper surface of the left side of the second portion is configured to abut a surface of a peripheral recess in the water craft; and said second lower surface of the left side of the second portion forms the transverse angle of taper with the median plane.

4. The fin box of claim 2 wherein:

said third upper surface of said right side of the second portion forms the transverse angle of taper with said median plane;

said third upper surface of the right side of the second portion is configured to abut a surface of a peripheral recess in the water craft, wherein the peripheral recess is adjacent the body portion recess;

the second lower surface of said of the left side of the second portion forms the transverse angle of taper with said median plane of said body portion, and said second lower surface of the left side of the second portion is configured to abut an inner surface of a skin of said water craft.

5. The fin box of claim 2 wherein the third upper side surface on the left side forms the transverse angle of taper with said median plane of said body portion;

said third upper surface on said left side of the second portion is configured to abut a surface of said peripheral recess;

a the second lower surface on the right side of the second portion forms the angle of taper with said median plane of said body portion, and said second lower surface on the right side is configured to abut an inner surface of a glassed skin of said water craft.

6. The fin box of claim 1 wherein the third upper surface on the right side of the second portion forms the angle of taper with said median plane;

the third upper surface of the left side of the second portion forms the angle of taper with said median plane;

the second lower surface on the right side of the second portion forms the angle of taper with said median plane, and the second lower surface of said left side of the second portion forms the angle of taper with said median plane.

7. The fin box of claim 2 wherein:

the third upper surface of the left side of said second portion of the peripheral flange forms a right angle with said median plane of said body portion;

said third upper surface of the left side of the second portion is configured to abut a surface of a peripheral recess in the core, wherein the peripheral recess is adjacent to the body recess;

the second lower surface of said left side of the second portion forms the angle of taper with said median plane, and the second side surface of the left side of the second portion is configured to abut an inner surface of a glassed skin of said water craft.

8. The fin box of claim 2 wherein the third upper surface of said right side of the second portion of the peripheral flange forms a right angle with said median plane of said body portion;

said third upper surface of the right side of the second portion is configured to abut a surface of a peripheral recess in the core, wherein the peripheral recess is adjacent to the body recess;

the second lower surface of right side of said second portion forms the angle of taper with said median plane, and said second lower surface of right side of the second portion is configured to abut an inner surface of a glassed skin of said water craft.

9. The fin box of claim 2 wherein:

the third upper surface of the left side of the second portion of said peripheral flange forms the angle of taper with said median plane;

said third upper surface of the left side of the second portion is configured to abut a surface of a peripheral recess in the core, wherein the peripheral recess is adjacent to the body recess;

the second lower surface of the left side of said second portion forms the angle of taper with said median plane; and said second lower surface of the left side of the second portion is configured to abut an inner surface of a glassed skin of said water craft.

10. The fin box of claim 1 wherein said elongated slot includes at least two elongated slots separated by a transverse strengthening rib in the fin box.

11. A releasable fin assembly including a fin box insertable in an underside of a water craft and releasibly attaching a fin to the water craft, said fin box comprising:

a body portion including a left sidewall and a right sidewall between which are an elongated slot open at a first surface of said body portion and said elongated slot extending between the sidewalls to a base spanning between the left and right sidewalls of the body portion, wherein the slot defines a median plane extending lengthwise through the slot and between the left and right sidewalls;

a peripheral flange extending transversely from said body portion, a first portion of said flange defining an area of said first surface around said elongated slot;

a second portion of said flange including a left side extending transversely from the left sidewall and a right side extending transversely from the right sidewall, the left side and the right side each include a second lower surface and a third upper surface, said second portion is offset from said first surface in a direction towards the base, and said second lower surface and said third upper surface of each of the left side and the right side of the second portion extend transversely from the body portion to a peripheral extremity of said peripheral flange;

wherein at least one of the second lower surface and the third upper surface is tapered at an angle transverse to the median plane, said taper being uniformly distributed across a width of at least one of the surfaces of said peripheral flange, and said fin includes a foil section and a fin tab section, said fin tab section of the fin includes an elongated screw retaining recess on at least one side of the fin tab section, said fin is retained in the elongated slot by at least one screw driven through at least one angled screw hole extending from a first surface of said fin box to at least one internal surface of said left or right sidewalls of the elongated slot and said screw engaging with a fin tab of a fin inserted in said elongated slot.

12. The releasable fin assembly of claim 11 wherein an overall length of the fin tab section is shorter than an overall length of the elongated slot of the fin box, and said at least one screw abuts the elongated screw retaining recess of the fin tab.

13. The releasable fin assembly of claim 11 wherein said screw is a stainless steel screw, and said screw includes an unthreaded head portion and a threaded shank portion.

14. The releasable fin assembly of claim 13 wherein said at least one angled hole includes a threaded portion and a recessed portion slightly larger than a root diameter of said threaded portion;

said recessed portion configured to accommodate said unthreaded head portion of a said screw, and said screw and said recessed portion are arranged to limit an extent to which said screw may be driven through said hole.

15. The releasable fin assembly of claim 14 wherein the fin tab of the fin contains at least one screw retention recess on at least one side of the fin tab.

16. The releasable fin assembly of claim 1 wherein said peripheral flange includes perforations in at least one of the left or right sides of the second portion of the said peripheral flange, said perforations arranged in a pattern forming a slot or identifying mark or logo.

17. The fin box of claim 1 wherein said peripheral flange includes grooves on at least one of the second lower surface and the third upper surface of the second portion of the peripheral flange.

18. A fin box for a water craft comprising:

a fin box body including left and right sidewalls, and an elongated slot between the sidewalls, wherein the slot is open at a first surface of the fin box and extends down into the fin box body to a base of the fin box and the slot has an median plane extending the length of the slot;

the peripheral flange including left side portion extending outwardly from the left sidewall and a right side portion extending outwardly from the right sidewall, the left side and right side portions each include a lower surface and an upper surface opposite to the lower surface, wherein the lower surface and the upper surface of the left side portion extend from the left sidewall to a periphery of the left side portion, and the lower and upper surface of the right side portion extend from the right sidewall to a periphery of the right side portion, wherein the peripheral flange is offset from the first surface wherein at least one of the lower surface and the upper surface of each of the left side portion and the right side portion is tapered to form a transverse angle of taper with the median plane.

19. A fin box for releaseably attaching a fin to a water craft, said fin box comprising:

a body portion configured to be inserted into a recess in the water craft, the body portion including left and right sidewalls, a bottom extending between the sidewalls, and slot defined by the sidewalls and bottom, wherein the slot is open at an upper end of the body portion, wherein the slot includes a median plane extending lengthwise along the slot and the slot is configured to receive the fin;

a peripheral flange extending transversely from said body portion, wherein a first portion of said flange defining a surface area of the body portion adjacent the opening of the slot;

a second portion of said flange is offset from the first portion of the peripheral flange towards the bottom of the body portion, wherein the second portion includes a right side section extending transversely from the right sidewall and a left side section extending transversely from the left sidewall, and at least one surface of the right side section and the left side section of the second portion is tapered at an angle transverse to the median plane, wherein the taper of at least one surface is uniform across length of the at least one surface which extends the length of the body portion and a width of the at least one surface which extends from one of the sidewalls to a peripheral edge of the flange.

* * * * *